US011926985B2

(12) United States Patent
Robertson

(10) Patent No.: US 11,926,985 B2
(45) Date of Patent: Mar. 12, 2024

(54) PIER SUPPORT SYSTEM

(71) Applicant: Steven Robertson, Ada, OK (US)

(72) Inventor: Steven Robertson, Ada, OK (US)

( * ) Notice: Subject to any disclaimer, the term of this patent is extended or adjusted under 35 U.S.C. 154(b) by 0 days.

(21) Appl. No.: 17/643,707

(22) Filed: Dec. 10, 2021

(65) Prior Publication Data

US 2023/0183936 A1 Jun. 15, 2023

(51) Int. Cl.
*E02D 27/01* (2006.01)
*E02D 27/48* (2006.01)
*E02D 35/00* (2006.01)

(52) U.S. Cl.
CPC ..... *E02D 35/005* (2013.01); *E02D 27/48* (2013.01)

(58) Field of Classification Search
CPC ..... E02D 35/005; E02D 27/48; E02D 27/01; E02D 27/34; E02D 5/00; E04B 1/34352; E02B 3/068; E01D 15/14; B66F 3/24
See application file for complete search history.

(56) References Cited

U.S. PATENT DOCUMENTS 1,558,430 A * 10/1925 Goldsborough ..... E02D 27/48 405/230
2,694,538 A * 11/1954 Consolo ..... A01K 97/10 248/533
2,801,522 A * 8/1957 Kuhn ..... E21D 23/06 405/297
2,907,172 A * 10/1959 Crake ..... E02B 17/027 405/209
3,222,030 A * 12/1965 Thorpe ..... E04F 15/02452 254/133 R
3,226,933 A * 1/1966 White ..... E02D 27/48 405/262
3,347,002 A * 10/1967 Penkunh ..... E02D 27/34 405/230
3,572,743 A * 3/1971 Parr ..... B60P 3/1033 280/43.23
4,188,681 A * 2/1980 Tada ..... B23Q 1/5462 248/182.1
4,194,523 A * 3/1980 Lubieniecki ..... F16K 27/07 251/291
4,235,399 A * 11/1980 Shorey ..... B64C 1/22 14/72.5
4,344,378 A * 8/1982 Martin ..... B63B 21/045 D8/382
4,678,373 A * 7/1987 Langenbach, Jr. ..... E02D 27/48 405/230
4,838,737 A * 6/1989 Quimby ..... E02D 5/60 405/230
4,848,260 A * 7/1989 Hamilton ..... E02B 3/064 114/267

(Continued)

FOREIGN PATENT DOCUMENTS

WO WO2004081293 A3 9/2004

*Primary Examiner* — Edwin J Toledo-Duran

(57) ABSTRACT

The present invention relates to a pier support system that provides for efficient and effective stabilization and lifting of foundations and structures. The present invention relates to a one-piece or one-part pier support system that provides for efficient and effective stabilization and lifting of foundations and structures. The present invention relates to methods of using one-piece of one-part pier support systems that are efficient and effective in stabilizing and lifting foundations and structures.

20 Claims, 4 Drawing Sheets

(56) References Cited

U.S. PATENT DOCUMENTS 5,011,336 A * 4/1991 Hamilton ..... E02D 27/48 405/230
5,018,905 A * 5/1991 Kinder ..... E02D 27/48 405/230
5,031,566 A * 7/1991 Switzer ..... B63B 15/00 114/361
5,085,537 A * 2/1992 Laditka ..... E01C 19/42 404/112
5,116,355 A * 5/1992 Freeman, III ..... E02D 27/48 405/230
5,120,016 A * 6/1992 Dysarz ..... A01K 97/10 248/539
5,171,107 A * 12/1992 Hamilton ..... E02D 27/48 405/230
5,213,448 A * 5/1993 Seider ..... E02D 27/48 405/230
5,217,325 A * 6/1993 Freeman, III ..... E02D 27/48 405/230
5,282,434 A * 2/1994 Hart ..... B63B 21/00 114/230.16
5,482,407 A * 1/1996 Raaf ..... E02D 27/48 405/230
5,575,234 A * 11/1996 Dysarz ..... B63B 21/00 114/230.27
5,800,094 A * 9/1998 Jones ..... E02D 35/00 254/133 R
5,819,482 A * 10/1998 Belke ..... E04G 25/06 248/354.3
5,870,866 A * 2/1999 Herndon ..... E02D 27/48 52/126.6
5,873,679 A * 2/1999 Cusimano ..... E04B 1/34347 405/251
5,941,191 A * 8/1999 Dysarz ..... E02B 3/24 114/230.26
6,183,167 B1 2/2001 Ruiz et al.
6,200,070 B1 * 3/2001 Knight ..... E02D 27/48 405/230
6,324,795 B1 * 12/2001 Stiles ..... E02D 27/34 52/167.7
6,352,390 B1 * 3/2002 Jones ..... E02D 35/00 405/230
6,352,391 B1 * 3/2002 Jones ..... E02D 5/801 405/253
6,361,252 B1 * 3/2002 Leitheiser ..... E02B 3/068 405/196
6,468,002 B1 * 10/2002 Gregory ..... E02D 35/00 405/230
6,662,740 B1 * 12/2003 Noe ..... E02B 3/24 114/230.11
6,682,267 B1 * 1/2004 Jones ..... E02D 35/00 405/253
6,817,810 B2 * 11/2004 Jones ..... E02D 35/00 405/253
7,429,149 B2 9/2008 Price et al.
D613,881 S * 4/2010 Perko ..... D25/122
8,851,800 B2 10/2014 Patton
9,631,335 B2 * 4/2017 Reusing ..... E02D 5/526
10,801,173 B1 10/2020 White
11,306,458 B1 * 4/2022 Wells ..... E02D 35/005
2003/0033760 A1 * 2/2003 Rogers ..... E04B 1/34352 52/126.6
2006/0216117 A1 * 9/2006 Peterson ..... E02D 35/00 405/230
2007/0006540 A1 * 1/2007 Linse ..... E02D 27/01 52/263
2010/0166504 A1 * 7/2010 Patton ..... E02D 5/00 405/230
2012/0255242 A1 * 10/2012 Patton ..... E01D 15/14 52/741.15
2014/0352449 A1 * 12/2014 Hale ..... E02D 33/00 73/786
2014/0356075 A1 * 12/2014 Hale ..... E02D 7/02 405/230
2015/0021530 A1 * 1/2015 Gregory ..... E02D 35/005 254/30
2016/0215470 A1 * 7/2016 Reusing ..... E02D 5/526
2018/0339750 A1 * 11/2018 Knapp ..... B63B 21/26
2019/0127944 A1 * 5/2019 Marshall ..... E02D 35/005
2020/0270827 A1 * 8/2020 Newcomb ..... E02D 35/005

* cited by examiner

PIER SUPPORT SYSTEM

FIELD OF THE INVENTION

The present invention relates generally to pier support systems for stabilizing, supporting and/or lifting the foundation of buildings and other structures. The present invention relates generally to one-piece or one-part pier systems for stabilizing, supporting and/or lifting the foundation of buildings and other structures. The present invention relates generally to methods of using a pier support system for stabilizing, supporting and/or lifting the foundation of buildings and other structures.

BACKGROUND OF THE INVENTION

Structures such as commercial buildings and residential houses often become unstable when their foundations settle or otherwise become unstable. While a variety of factors may contribute to such instability, unstable ground soil and faulty construction are common causes. When instability occurs, substantial damage to the structure may occur. As a result, the foundation and thus the structure itself must be stabilized.

A variety of methods of stabilizing, supporting and lifting unstable foundations have been devised. For example, unstable foundations may be vertically supported by a pier system. A pier system may include piers sunk below the foundation to rest on a stable surface such as bedrock, while the pier extends upward to the foundation to provide support.

However, traditional pier systems are known to have several disadvantages. When the foundation of a structure does not provide a level, flat or horizontal surface for the pier to push against, any movement of the foundation may result in separation of the foundation from the pier, even breakage off the pier due to offset loading. For instance, concentrically loaded pier systems commonly break during use due to offset loading of the pier that may result from any shift in the foundation or even improper installation. In fact, improper installation is not uncommon due to the fact that traditional piers are made up of many separate parts and are complicated to install.

Even when installed properly, the many separate parts that make up traditional piers results in several disadvantages. Traditional pier systems require a number of adjusting components (or shims) that may be placed between the pier and a lifting plate against or attached to the foundation. Typically, these adjusting components are loose and often fall off when the structure heaves, shifts or otherwise moves after installation. While it may be possible to attach the adjusting component to the pier so that it does not move during use, said process of attachment and the calculations and adjustment necessary for the attachment, makes the pier and its use complicated and time-consuming.

Furthermore, traditional pier systems are comprised of pier sections that are not permanently affixed to one another. While these pipe sections may be fitted together in various ways, often the manner in which the sections are joined is critical. For instance, piers that are installed directly under the wall of a foundation are typically made up of several short segments of pipe, where the connection point between these segments must be extremely strong lest it break. Moreover, given the loads that are placed on piers, and that a pier may be driven into the ground, the connection point must be able to withstand extreme compressive loads. Pier segments that are merely screwed or bolted together may collapse under such loads. While there are pier systems where pier segments are connected through their threaded ends, such pier systems are expensive to manufacture and also complicated and time-consuming to install.

Accordingly, there is a need for improved pier support systems that are able to address the problems associated with traditional pier support systems.

SUMMARY OF THE INVENTION

In an exemplary embodiment, the present invention provides for pier support systems for stabilizing, supporting and/or lifting a foundation and/or structure. In an exemplary embodiment, the present invention provides for one-piece or one-part pier support systems for stabilizing, supporting and/or lifting a foundation and/or structure. In an exemplary embodiment, the present invention provides for a method of using pier support systems for stabilizing, supporting and/or lifting a foundation and/or structure.

DESCRIPTION OF THE INVENTION

The present invention is described herein in exemplary form. The description herein is not intended to limit the scope of the invention or this patent. Rather, it is contemplated that the claimed subject matter might also be embodied in other ways, to include additional features or combinations of features similar to the ones described herein.

Figure 1:
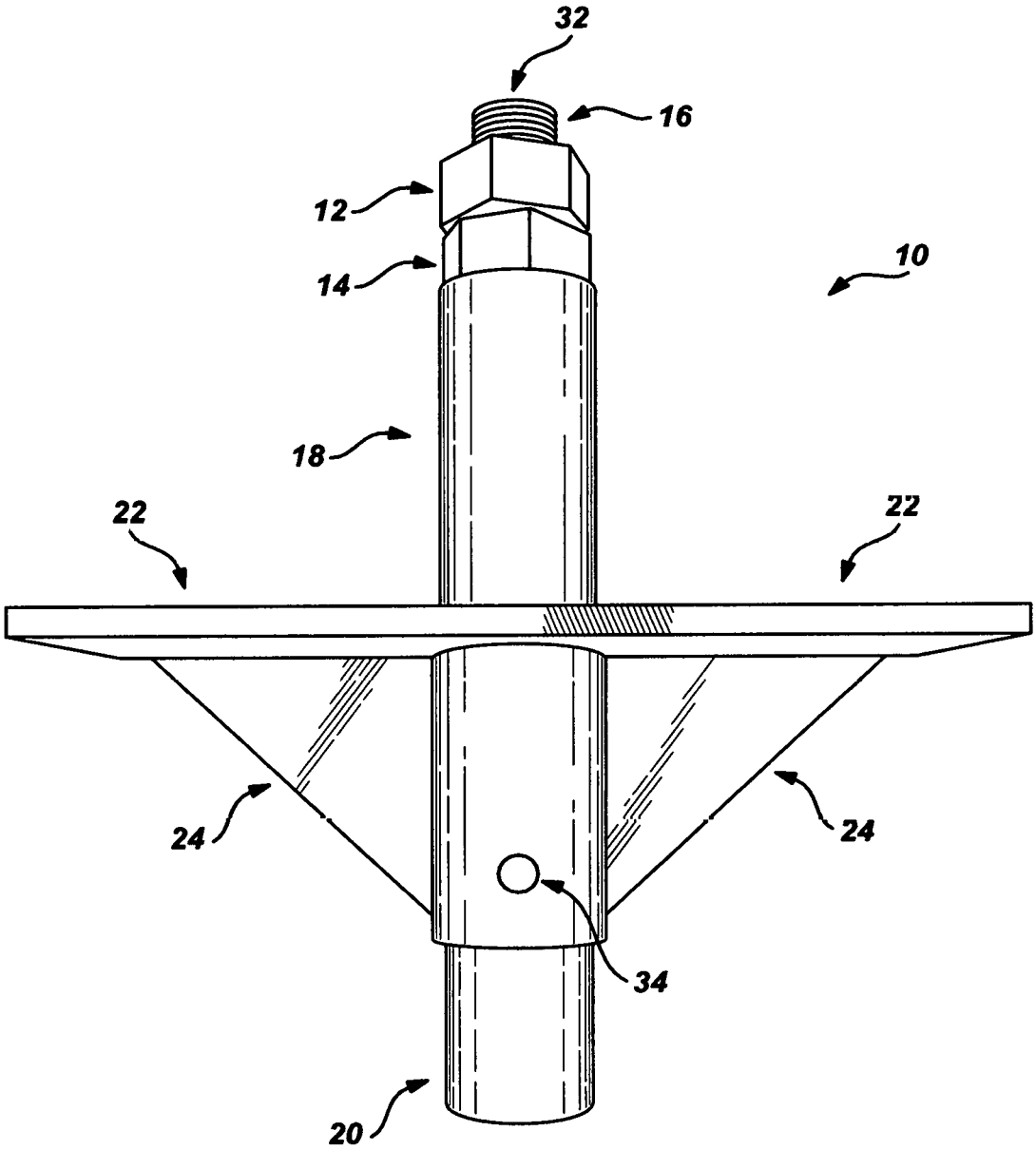
FIG. 1 is perspective view of a pier support system according to an exemplary embodiment of the present invention.
Figure 2:
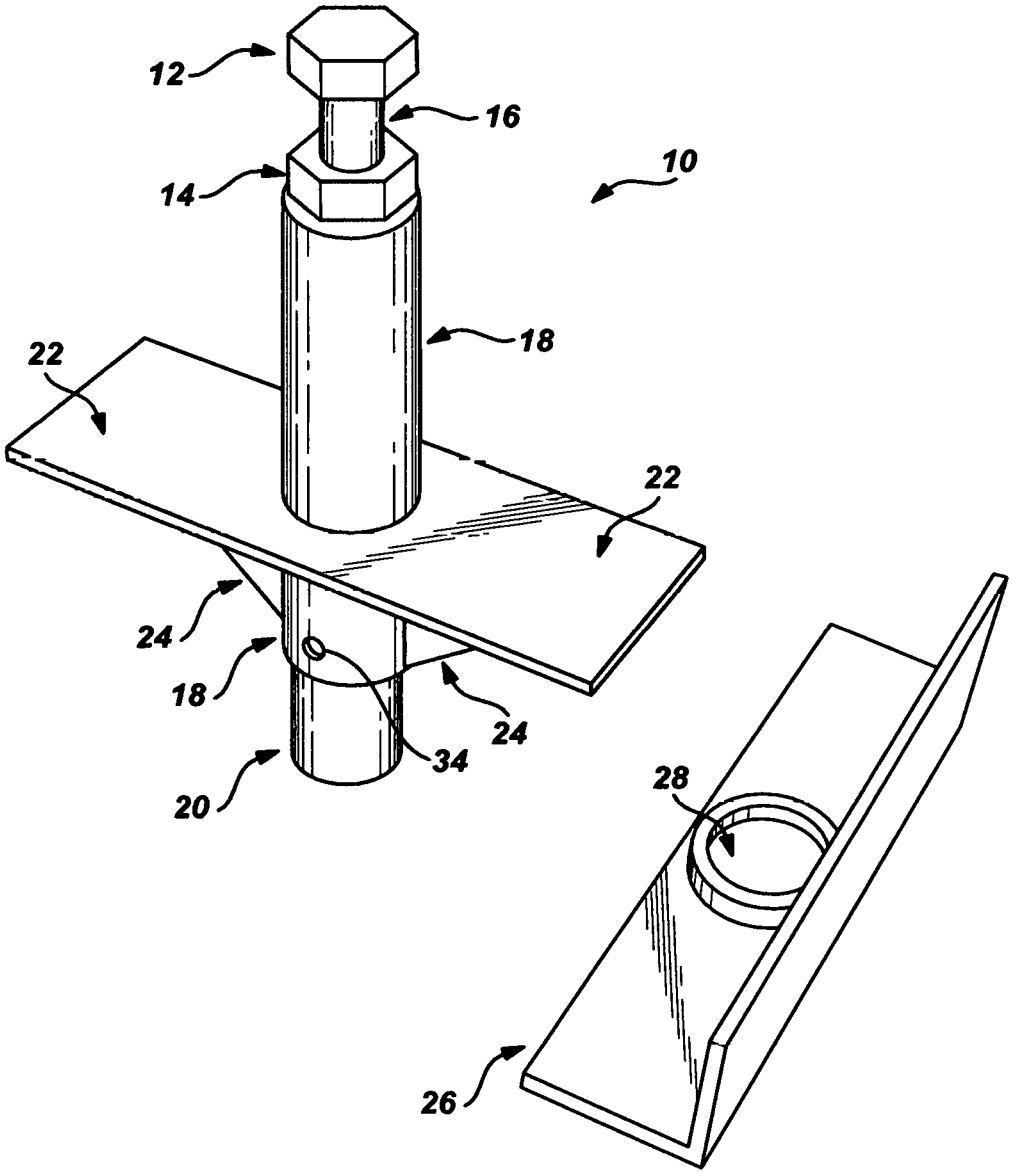
FIG. 2 is a perspective view of a pier support system according to an exemplary embodiment of the present invention.

An exemplary embodiment of the pier support system of the present invention is shown in FIGS. 1 and 2 and is generally indicated by reference number 10. The pier support system 10 according to an exemplary embodiment includes a base pier cylinder 20, an upper pier cylinder 18, a receptor nut 14, a support plate 22, an adjustment nut 12, and a stud 16. In an exemplary embodiment, the receptor nut 14 is a threaded receptor nut. In an exemplary embodiment, the adjustment nut 12 is a threaded adjustment nut 12. In an exemplary embodiment, the stud 16 is a threaded stud 16 having a distal end 32. In an exemplary embodiment, the pier support system 10 includes at least one gusset 24, preferably two gussets 24.

With reference to FIGS. 1, 2 and 3, in an exemplary embodiment, a pier support system 10 may include an adjustment mechanism. In one exemplary embodiment, the adjustment mechanism may include a threaded member 16, a threaded adjustment nut 12 fixedly attached to a distal end 32 of the threaded member 16, and the other end of the threaded member 16 threaded into the threaded receptor nut 14 of the upper pier column 18. In one exemplary embodiment, an adjustment mechanism may include a threaded adjustment nut 12 fixedly attached to a distal end 32 of a threaded stud 16 that is threaded into the threaded receptor nut 14.

With reference to FIGS. 1, 2 and 3 by way of example, the pier support system 10 of the present invention is a one-piece or one-part pier support system 10, where the different sections of the pier support system are attached or connected. In one exemplary embodiment, a base pier cylinder 20 is fixedly attached to an upper pier cylinder 18. In one exemplary embodiment, a threaded receptor nut 14 is fixedly attached to an upper pier cylinder 18, preferably one end of the upper pier cylinder 18. In an exemplary embodiment, a support plate 22 is fixedly attached to the upper pier cylinder. In an exemplary embodiment, a support plate 22 is fixedly attached to the base pier cylinder 20. In an exemplary embodiment, at least one gusset 24 is used when fixedly attaching the support plate 22 and the upper pier cylinder 18. In an exemplary embodiment, an adjustment mechanism includes a threaded adjustment nut 12 fixedly attached to one end, preferably a distal end 32, of a threaded stud 16.

With reference to FIGS. 1, 2, 3 and 4, those of ordinary skill in the art will recognize that in exemplary embodiments the different parts and/or sections of the pier support system 10 may be fixedly attached to each other by welding, bolting, threading or other semi-permanent or permanent means of connecting the parts and/or sections together. Preferably, different parts and/or sections of the pier support system 10 are fixedly attached by welding the parts and/or sections together. In an exemplary embodiment, the base pier column or cylinder 20 is welded to the upper pier column or cylinder 18, the receptor nut 14 is welded to the upper pier column or cylinder 18, the support plate 22 is welded to the upper pier column or cylinder 18 and/or the adjustment nut 12 is welded to the threaded member or stud 16. In an exemplary embodiment, the at least one gusset 24 is welded to the support plate 22 and the upper pier column or cylinder 18. In an exemplary embodiment, the threaded member or stud 16 is fixedly attached by threading the stud 16 into the receptor nut 14. In an exemplary embodiment, the adjustment nut 12 is fixedly attached by being threaded onto the threaded member or stud 16 and then welded to the threaded member or stud 16.

Figure 3A:
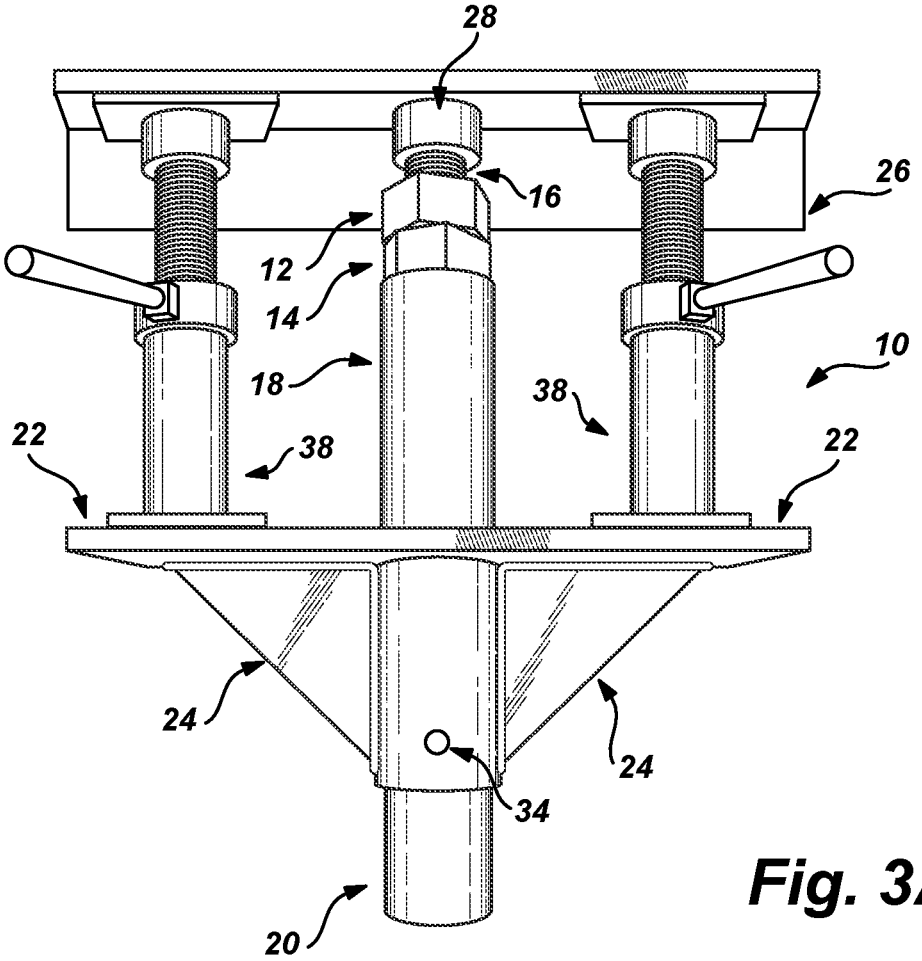
FIG. 3A is a side view of a pier support system according to an exemplary embodiment of the present invention.
Figure 3B:
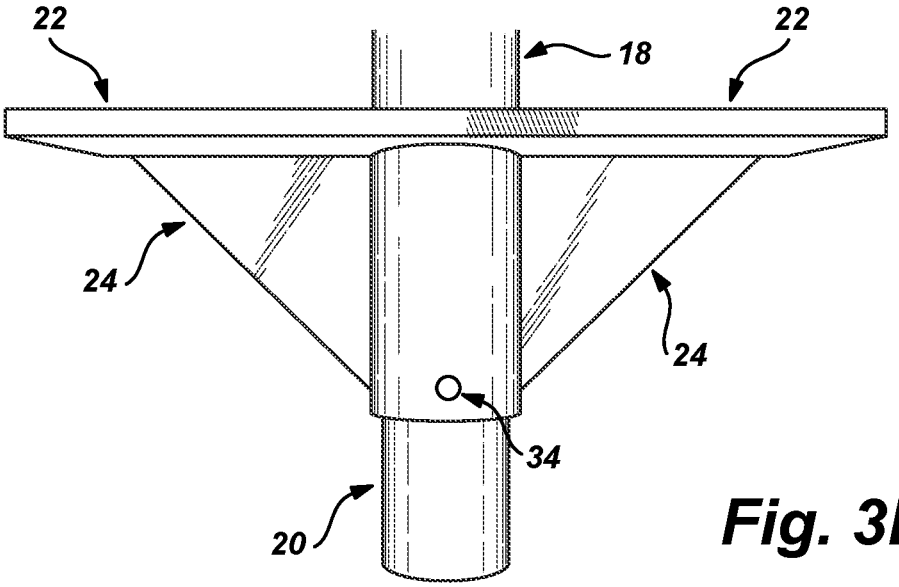
FIG. 3B is a side view of a lower section of a pier support system according to an exemplary embodiment of the present invention.

With reference to FIG. 3A by way of example, fixedly attach various parts and/or sections of the invention by welding may be demonstrated. With reference to FIG. 3A, exemplary welds and/or weld points are shown for example where the receptor nut 14 is welded to the upper pier column or cylinder 18 and multiple gussets 24 are welded to the support plate 22 and the upper pier column or cylinder 18. Those of ordinary skill in the art will recognize that welds and weld points may be employed in other areas of the pier support system in order to fixedly attach different parts and/or sections of the present invention.

Figure 4:
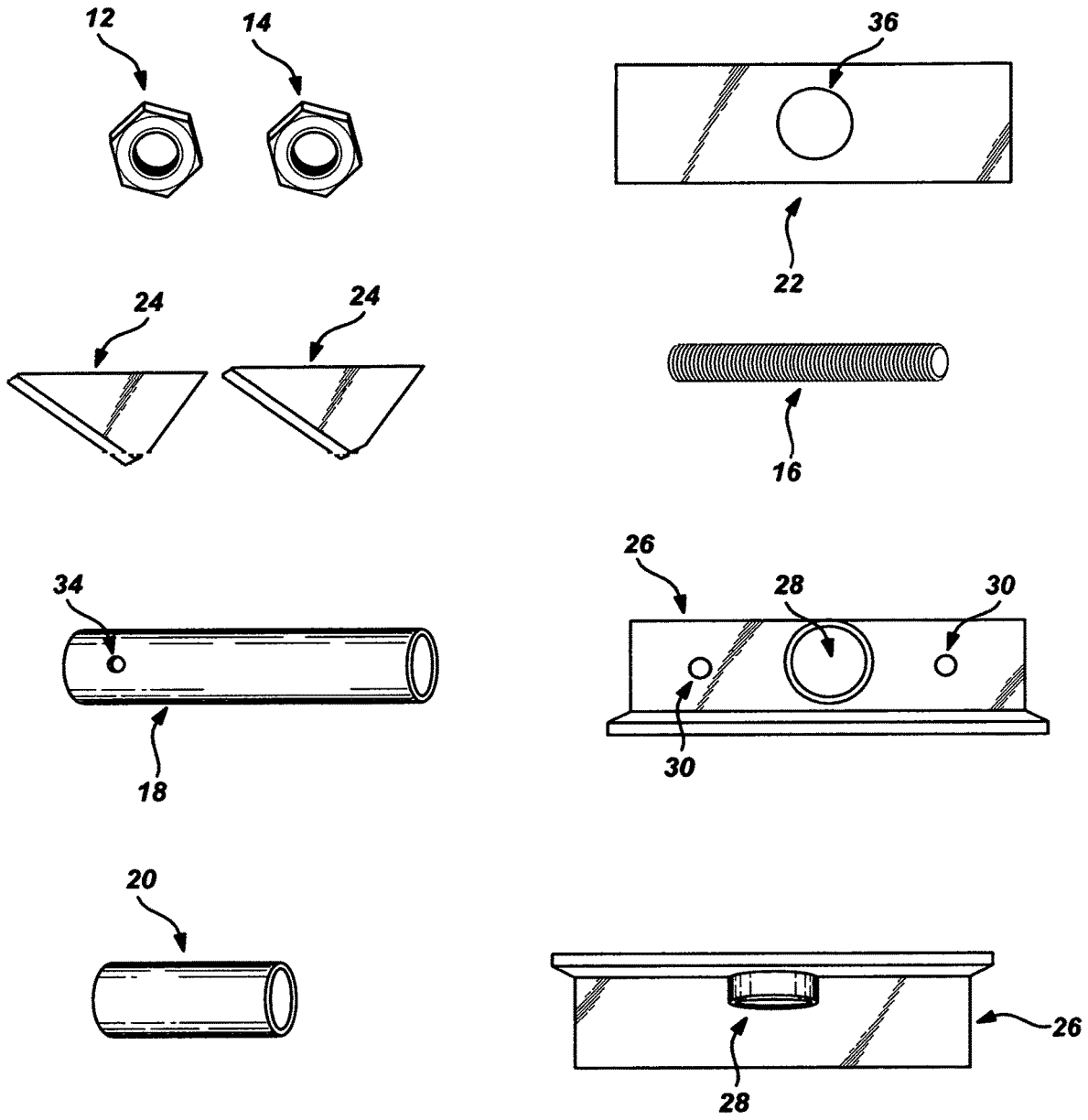
FIG. 4 is a prior to assembly view of parts of an exemplary embodiment of the present invention.

With reference to the prior to assembly view of FIG. 4, in an exemplary embodiment the different parts and/or sections of the pier support system 10 may include an adjustment nut 12, a receptor nut 14, a threaded member or stud 16, an upper pier cylinder or column 18, a base pier cylinder or column 20, a support plate 22, at least one gusset 24 and a lifting plate 26, preferably a lifting plate 26 having an open socket 28.

With reference to FIGS. 1, 2 and 3, in an exemplary pier support system 10 of the present invention, a base pier cylinder 20 is fixedly attached to an upper pier cylinder 18, a threaded receptor nut 14 is fixedly attached to one end of the upper pier cylinder 18, a support plate 22 is fixedly attached to the upper pier cylinder 18. In an exemplary embodiment, the support plate 22 is fixedly attached to at least one gusset 24 which may also be fixedly attached to the upper pier cylinder 18. In an exemplary embodiment, the adjustment mechanism comprises a threaded adjustment nut 12 fixedly attached to one end of a threaded stud 16 that is threaded into the threaded receptor nut 14.

With reference to FIGS. 2 and 4, the pier support system 10 according to an exemplary embodiment may include a lifting plate 26, preferably a lifting plate 26 having an open socket 28. Preferably, the lifting plate 26 has an open socket 28 configured to receive one end 32, preferably a distal end 32, of a threaded member or stud 16. The lifting plate 26 may be attached to a foundation of a building, house or other structure. In an exemplary embodiment, the lifting plate 26 may be attached to a foundation via bolts, lag bolts, screws, studs and/or concrete anchors. With reference to FIG. 4, in an exemplary embodiment the lifting plate 26 may include pre-drilled holes 30 through which bolts, lag bolts, screws, studs and/or concrete anchors may be inserted to attach the lifting plate 26 to a foundation. Upon attaching the lifting plate 26 to the foundation, the open socket 28 of the lifting plate may receive the distal end 32 of the threaded member or stud 16 of the pier support system 10. In an exemplary embodiment, by adjusting or turning the adjustment nut 12, the vertical height of the threaded member or stud 16 may be adjusted in order to vertically support or lift the lifting plate 26, preferably vertically supporting or lifting the lifting plate 26 against the foundation.

As shown with reference to FIGS. 1, 2 and 3, an exemplary one-part pier support system 10 of the present invention may comprise a base pier cylinder 20 fixedly attached to an upper pier cylinder 18, a threaded receptor nut 14 fixedly attached to one end of the upper pier cylinder 18, a support plate 22 fixedly attached to the upper pier cylinder 18 or base pier cylinder 20, and an adjustment mechanism comprising a threaded adjustment nut 12 fixedly attached to one end 32 of a threaded stud 16 that is threaded into the threaded receptor nut 14.

By way of exemplary embodiment, the one-part pier support system 10 may comprise a lifting plate 26 having an open socket 28 configured to receive one end 32, preferably a distal end 32, of a threaded member or stud 16 of the adjustment mechanism.

By way of exemplary embodiment, the one-part pier support system 10 may comprise the inner diameter of the upper pier cylinder 18 being such that the base pier cylinder 20 may be inserted at least partially into one end of the upper pier cylinder 18.

By way of exemplary embodiment, the one-part pier support system 10 may comprise that the base pier cylinder 20 and upper pier cylinder 18 are fixedly attached by welding.

By way of exemplary embodiment, the one-part pier support system 10 may comprise the threaded receptor nut 14 fixedly attached to the upper pier cylinder 18 by welding.

By way of exemplary embodiment, the one-part pier support system 10 may comprise the threaded adjustment nut 12 of the adjustment mechanism being threaded onto the threaded stud 16 and fixedly attached by welding.

By way of exemplary embodiment, the one-part pier support system 10 may comprise the height of the adjustment mechanism being adjusted by adjusting or turning the threaded adjustment nut 12. By way of exemplary embodiment, the one-part pier support system 10 may comprise the height of the threaded member or stud 16, preferably the end 32 or distal end 32, being adjusted by adjusting or turning the threaded adjustment nut 12.

Another exemplary embodiment of the pier support system of the present invention may also be described with reference to FIGS. 1, 2 and 3 and is generally indicated by reference number 10. The pier support system 10 according to an exemplary embodiment includes a base pier column 20, an upper pier column 18, a receptor nut 14, a support plate 22, an adjustment nut 12, and a stud 16. In an exemplary embodiment, the receptor nut 14 is a threaded receptor nut 14. In an exemplary embodiment, the adjustment nut 12 is a threaded adjustment nut 12. In an exemplary embodiment, the stud 16 is a threaded stud 16.

With reference to FIGS. 1, 2 and 3, in an exemplary embodiment, a pier support system includes an upper pier column 18 fixedly attached to the base pier column 20, where a threaded receptor nut 14 is fixedly attached to one end of the upper pier column 18, a support plate 22 fixedly attached to the upper pier column 18 or base pier column 20, an adjustment mechanism comprising a threaded member 16 and a threaded adjustment nut 12 fixedly attached to one distal end 32 of the threaded member 16, where the other end of the threaded member 16 is threaded into the threaded receptor nut 14, and a lifting plate 26 having a socket 28 fixedly attached to the plate, where the socket 28 is configured to receive an end 32, preferably a distal end 32, of the threaded member 16.

By way of exemplary embodiment, the pier support system 10 may comprise the upper pier column 18 having an inner diameter such that the base pier column 20 may be inserted at least partially into one end of the upper pier column 18.

By way of exemplary embodiment, the pier support system 10 may comprise the base pier column 20 and the upper pier column 10 being fixedly attached by welding.

By way of exemplary embodiment, the pier support system 10 may comprise the threaded receptor nut 14 being fixedly attached to the upper pier column 18 by welding.

By way of exemplary embodiment, the pier support system 10 may comprise the base pier column 20 and the upper pier column 18 being cylindrical pipe.

By way of exemplary embodiment, the pier support system 10 may comprise the support plate 22 being fixedly attached by welding, preferably fixedly attached to the upper pier column 18 or base pier column 20, preferably fixedly attached to the upper pier column 18.

By way of exemplary embodiment, the pier support system 10 may comprise at least one gusset that may be fixedly attached to the upper pier column 18 and the support plate 22.

By way of exemplary embodiment, the pier support system 10 may comprise the threaded adjustment nut 12 of the adjustment mechanism being threaded onto the threaded member 16 and being fixedly attached by welding.

By way of exemplary embodiment, the pier support system 10 may comprise the height of the adjustment mechanism being adjusted by adjusting the threaded adjustment nut 12, preferably by turning the threaded adjustment nut 12.

By way of exemplary embodiment, the pier support system 10 may comprise the lifting plate 26 being attached to a foundation of a building, home or other structure.

A prior to assembly view of parts and/or sections of an exemplary embodiment of the present invention is shown in FIG. 4. Those of ordinary skill in the art will recognize that FIG. 4 shows certain parts and/or sections that may be combined and fixedly attached according to exemplary embodiments of the one-piece or one-part pier support system of the present invention. As shown in FIG. 4, a pier support system may include a threaded adjustment nut 12 and a threaded receptor nut 14. A pier support system may include a threaded stud 16. A pier support system may include an upper pier column 18. A pier support system may include a base pier column 20. A pier support system may include a support plate 22. A pier support system may include at least one gusset 24, preferably at least two gussets 24. A pier support system may include a lifting plate 26 having a socket 28, preferably a lifting plate 26 having a socket 28 fixedly attached to the lifting plate 26. With reference to FIGS. 1, 2 and 3, those of ordinary skill in the art will recognize that it is possible to combine the parts and/or sections shown in FIG. 4, and fixedly attach those parts and/or sections in the exemplary manners described herein, to thereby form an exemplary one-piece or one-part pier system 10 according to the present invention.

With reference to FIGS. 1, 2, 3 and 4, by way of example, the pier support system 10 of the invention may include a base pier column 20 or cylinder 20. With reference to FIGS. 3A and 3B by way of example, the base pier column 20 or cylinder 20 may have an outer diameter such that the base pier column 20 or cylinder 20 may be inserted into an upper pier column 18 or cylinder 18, and preferably fixedly attached to the upper pier column 18 or cylinder 18.

With reference to FIGS. 1, 2, 3 and 4, by way of example, the pier support system 10 of the invention may include an upper pier column 18 or cylinder 18. With reference to FIGS. 1 and 3A by way of example, a threaded receptor nut 14 may be fixedly attached to one end of the upper pier column 18 or cylinder 18. With reference to FIGS. 1, 3A, 3B and 4 by way of example, the upper pier column 18 or cylinder 18 may include a hole 34 drilled therein through which the upper pier column 18 or cylinder 18 may be fixedly attached to the base pier column 20 or cylinder 20, preferably by welding, preferably via a plug weld as known to those of ordinary skill in the art.

With reference to FIGS. 1, 2, 3 and 4, by way of example, the pier support system 10 may include a support plate 22. With reference to FIG. 4, the support plate 22 may include a hole 36 therein through which an upper pier column or cylinder 18 may be inserted and then fixedly attached, preferably by welding the upper pier column or cylinder 18 and support plate 22.

With reference to FIGS. 1, 2, 3 and 4 by way of example, the pier support system 10 of the invention may include at least one gusset 24, preferably at least two gussets 24. With reference to FIGS. 3A and 3B, those of ordinary skill in the art will recognize that gussets may be fixedly attached to the upper pier column or cylinder 18 and the support plate 22. By such construction, the at least one gusset 24 may serve to support and strengthen the pier support system 10, thereby contributing to the one-piece or one-part construction of the system 10.

With reference to FIGS. 1, 2, 3 and 4, by way of example, the pier support system 10 of the invention may include a lifting plate, preferably a lifting plate 26 having a socket 28. As described herein, the lifting plate 26 may be attached to a foundation and/or structure via bolts, lag bolts, screws, studs and/or concrete anchors. By way of example, those of ordinary skill in the art will also recognize that upon completing a project and removing the one-piece or one-part pier support system 10, the lifting plate 26 may remain attached to the foundation and/or structure and left behind—i.e., the lifting plate 26 may be treated as sacrificial.

With reference to FIGS. 1, 2, 3 and 4 by way of example, the pier support system 10 of the invention may include an adjustment mechanism. In one exemplary embodiment, the adjustment mechanism of the invention may include a receptor nut 14, a member or stud 16, and an adjustment nut 12. In one exemplary embodiment, the adjustment mechanism of the invention may include a threaded adjustment nut 12 fixedly attached to a threaded stud 16 that is threaded into a threaded receptor nut 14.

With reference to FIGS. 1, 2 and 3, those of ordinary skill in the art will recognize that by one-piece or one-part it is meant that all parts and/or sections that make up the pier support system 10 are fixedly attached or connected such that no assembly of the pier support system 10 is required during use of the pier support system 10. With reference to FIG. 4, in that all parts and/or sections that comprise a one-piece or one-part pier support system 10 are fixedly attached or connected prior to use of the system 10, with no assembly of the system 10 required during actual use, the system 10 is simpler and more efficient than existing systems.

With reference to FIGS. 1, 2 and 3, those of ordinary skill in the art will recognize that an exemplary one-piece or one-part pier support system 10 of the present invention may be used to stabilize, support and/or lift foundations and/or buildings, homes and other structures. By way of exemplary embodiment, those of ordinary skill in the art will recognize that a hole or depression may be excavated beneath a foundation, and a section or sections of pipe inserted vertically into the hole or depression. The section or sections of pipe may be driven into the ground at the bottom of the hole or depression, either by hand or with the assistance of a ram or by other methods, preferably until the pipe will move downward no further, for example upon contacting bedrock. Those of ordinary skill in the art will recognize that the section or sections of pipe may have an inner diameter such that the base pier column or cylinder 20 of the one-part pier support system 10 may be inserted at least partially into the section or sections of pipe. As such, the one-part pier support system 10 in an exemplary embodiment may be supported by the section or sections of pipe inserted vertically into such hole or depression.

By way of exemplary embodiment, those of ordinary skill in the art will recognize that at least one jack 38 may be positioned on the support plate 22 of the pier support system. Preferably, two jacks 38 are positioned on the support plate 22, one jack 38 positioned on the upper horizontal surface of the support plate 22 that extends horizontally from one side of the upper pier column or cylinder 18 and another jack 38 positioned on the upper horizontal surface of the support plate 22 that extends horizontally from the other side of the upper pier column or cylinder 18. By way of exemplary embodiment, those of ordinary skill in the art will recognize that once positioned on the support plate 22, the at least one jack 38 may be raised vertically to contact the lower surface of the lifting plate 26, preferably to the lower surface of the lifting plate 26 that extends horizontally from the open socket 28 of the lifting plate 26. By way of example, once two jacks 38 are positioned on the support plate 22 of the pier support system 10, one jack 38 may be raised or extended vertically to contact the lower surface of the lifting plate 26 extending horizontally from one side of the open socket 28 and the second jack 38 may be raised or extended vertically to contact the lower surface of the lifting plate 26 extending horizontally from the other side of the open socket 28. By way of example, those of ordinary skill in the art will recognize that once positioned as described above, the at least one jack 38 may be used to apply a vertical lifting force to the lifting plate 26, preferably to the lifting plate 26 which is attached to a foundation. By way of example, those of ordinary skill in the art will recognize that the at least one jack 38 nay be used to apply a vertical lifting force to the lifting plate 26 to thereby support or lift the foundation.

By way of exemplary embodiment, those of ordinary skill in the art will recognize that once a foundation, building or structure is supported or lifted as described in the preceding paragraph, the adjustment nut 12 of the adjustment mechanism may be adjusted or turned so that the end 32, preferably the distal end 32, of the threaded member 16 is inserted into the socket 28 of the lifting plate 26. By way of example, those of ordinary skill in the art will recognize that once a foundation, building or structure is supported or lifted as described in the preceding paragraph, the adjustment nut 12 of the adjustment mechanism may be adjusted or turned so that the adjustment nut 12 is inserted at least partially into the socket 28 of the lifting plate 26. By way of example, those of ordinary skill in the art will recognize that once the lifting plate 26 is supported by the threaded member 16 and/or the adjustment nut 12 of the adjustment mechanism, the jacks 38 may be lowered and removed from the support plate 22. In such an exemplary embodiment, a foundation, building and/or structure may be supported by one or more pier support systems 10 as described herein.

By way of example, and with reference to FIGS. 1, 2 and 3, those of ordinary skill in the art will recognize that the one-part or one-piece pier support system 10 of the present invention may be used to stabilize or lift a structure, where the method includes: positioning the pier system 10 beneath the structure, positioning a lifting plate 26 between the pier system 10 and the structure, positioning at least one jack 38 on the support plate 22, adjusting the jack 38 to apply a vertical force to the lifting plate 26, adjusting the adjustment mechanism by adjusting the threaded adjustment nut 12 until one end 32, preferably the distal end 32, of the threaded member or stud is received by a socket 28 of the lifting plate 26.

By way of exemplary embodiment, the method may comprise fixedly attaching the lifting plate 26 to the foundation and/or structure. By way of example, the lifting plate 26 may be attached to a foundation and/or structure via bolts, lag bolts, screws, studs and/or concrete anchors. With reference to FIG. 4, in an exemplary embodiment the lifting plate 26 may include pre-drilled holes 30 through which bolts, lag bolts, screws, studs and/or concrete anchors may be inserted to attach the lifting plate 26 to a foundation and/or structure.

By way of exemplary embodiment, the method may comprise raising the height of the at least one jack 38 so as to support the lifting plate 26 against the structure and/or the foundation of the structure. By way of exemplary embodiment, the method may further comprise adjusting the adjustment mechanism so as to adjust the height of the distal end 32 of the threaded stud 16 so that the distal end 32 supports the lifting plate against the foundation and/or structure.

By way of exemplary embodiment, the method may comprise removing the at least one jack 38 from the support plate 22. By way of exemplary embodiment, the pier support system 10 may support the foundation and/or structure after removing the at least one jack 38.

The one-piece or one-part pier support system 10 of the present invention provides for numerous advantages. In that all parts and/or sections that make up the pier support system 10 are fixedly attached or connected such that no assembly is required during use, use of the pier support system 10 is simpler and easier, which results in increased efficiency in completing projects and thus provides for cost savings (e.g., in labor hours) The ease and simplicity of use also results in a safer work environment with reduced probability of accident and/or injury. Further reducing accident and/or injury is the fact that due to its one-piece or one-part construction, the pier support system 10 is stronger than existing systems. Furthermore, given that the pier support system 10 is constructed as one-piece or one-part, but remains adjustable as described herein, the system 10 eliminates the additional parts required by existing multi-piece or -part systems. For example, the adjustable one-part pier support system 10 of the present invention eliminates the need for shims and/or shim blocks, all of which are problematic in that such additional parts result in increased complexity of use. Shims and shim blocks are also problematic in that such additional parts during use often need to be repositioned, even replaced when such parts fall out or break during shifts in the ground or foundation, thereby again increasing complexity and decreasing efficiency and effectiveness. Such disadvantages are eliminated by the one-piece or one-part pier support system 10 of the present invention.

While aspects of the present invention are described herein and illustrated in the accompanying drawings, those of ordinary skill in the art will appreciate that the invention, in its broadest aspects, has further applicability.

It will be appreciated that the above description is merely exemplary in nature and is not intended to limit the present disclosure, its application or uses. Therefore, it is intended that the present disclosure not be limited to the particular examples illustrated by the drawings and described in the specification as the best mode presently contemplated for carrying out the teachings of the present disclosure, but that the scope of the present disclosure will include any embodiments falling within the foregoing description and the appended claims.

I claim:

1. A pier support system that comprises:

a base pier column, a single upper pier column fixedly attached to the base pier column, where a threaded receptor nut is fixedly attached to one end of the upper pier column, a support plate attached by a permanent direct contact connection to the single upper pier column, the support plate extending laterally from the single upper pier column, the single upper pier column passing through the support plate, where the one end of the single upper pier column extends above the support plate and a second other end of the single upper pier column extends below the support plate, an adjustment mechanism comprising a threaded member and a threaded adjustment nut fixedly attached to a distal end of the threaded member, where the other end of the threaded member is threaded into the threaded receptor nut of the single upper pier column, and a lifting plate having a socket fixedly attached to the plate, where the socket is configured to receive the distal end of the threaded member, wherein the support plate is configured so that at least one jack may be positioned on the upper horizontal surface of the support plate such that the jack may be extended vertically to contact and apply a vertical lifting force to the lifting plate, the lifting plate thereby contacting and applying the vertical lifting force to a structure.

2. The pier support system of claim 1, wherein the upper pier column has an inner diameter such that the base pier column is inserted at least partially into one end of the upper pier column.

3. The pier support system of claim 1, wherein the base pier column and the upper pier column are fixedly attached by welding.

4. The pier support system of claim 1, wherein the threaded receptor nut is fixedly attached to the upper pier column by welding.

5. The pier support system of claim 1, wherein the base pier column and the upper pier column are cylindrical pipe.

6. The pier support system of claim 1, wherein the support plate is fixedly attached by welding.

7. The pier support system of claim 1, wherein the threaded adjustment nut of the adjustment mechanism is threaded onto the threaded member and fixedly attached by welding.

8. The pier support system of claim 1, wherein the height of the adjustment mechanism is adjusted by adjusting the threaded adjustment nut.

9. The pier support system of claim 1, wherein the lifting plate is attached to a foundation.

10. A one-part pier support system, comprising:

a base pier cylinder fixedly attached to a single upper pier cylinder, a threaded receptor nut fixedly attached to one end of the upper pier cylinder, a support plate attached by a permanent direct contact connection to the single upper pier cylinder, the support plate extending laterally from the single upper pier column, the single upper pier column passing through the support plate, where the one end of the single upper pier column extends above the support plate and a second other end of the single upper pier column extends below the support plate, an adjustment mechanism comprising a threaded adjustment nut fixedly attached to one end of a threaded stud that is threaded into the threaded receptor nut, wherein the support plate is configured so that at least one jack may be positioned on an upper horizontal surface of the support plate such that the jack may be extended vertically to contact and apply a vertical lifting force to a lifting plate, the lifting plate thereby contacting and applying the vertical lifting force to a structure.

11. The one-part pier support system of claim 10, further comprising the lifting plate having an open socket configured to receive a distal end of the threaded stud.

12. The one-part pier support system of claim 10, wherein the inner diameter of the upper pier cylinder is such that the base pier cylinder is inserted at least partially into one end of the upper pier cylinder.

13. The one-part pier support system of claim 10, wherein the base pier cylinder and upper pier cylinder are fixedly attached by welding.

14. The one-part pier support system of claim 10, wherein the threaded receptor nut is fixedly attached to the upper pier cylinder by welding.

15. The one-part pier support system of claim 10, wherein the threaded adjustment nut of the adjustment mechanism is threaded onto the threaded stud and fixedly attached by welding.

16. The one-part pier support system of claim 10, wherein the height of the adjustment mechanism is adjusted by adjusting the threaded adjustment nut.

17. A method of using a pier system to stabilize or lift a structure, the pier system comprising:

a base pier cylinder fixedly attached to a single upper pier cylinder, a threaded receptor nut fixedly attached to one end of the single upper pier cylinder, a support plate attached by a permanent direct contact connection to the single upper pier cylinder, the support plate extending laterally from the single upper pier column, the single upper pier column passing through the support plate, where the one end of the single upper pier column extends above the support plate and a second other end of the single upper pier column extends below the support plate, an adjustment mechanism comprising a threaded adjustment nut fixedly attached to a threaded stud that is threaded into the threaded receptor nut, the method comprising:

positioning the pier system beneath the structure, positioning a lifting plate between the pier system and the structure, positioning at least one jack on the support plate, adjusting the jack to contact and apply a vertical force to the lifting plate, the lifting plate thereby contacting and applying the vertical force to the structure, adjusting the adjustment mechanism by adjusting the threaded adjustment nut so that the distal end of the threaded stud enters a socket of the lifting plate.

18. The method of claim 17, further comprising fixedly attaching the lifting plate to the structure.

19. The method of claim 17, further comprising adjusting the height of the distal end of the threaded stud so that the distal end supports the lifting plate against the structure.

20. The method of claim 17, further comprising removing the at least one jack from the support plate.

* * * * *